US010985489B2

(12) United States Patent
Sakai

(10) Patent No.: US 10,985,489 B2
(45) Date of Patent: Apr. 20, 2021

(54) CONNECTOR

(71) Applicant: Tyco Electronics Japan G.K., Kanagawa (JP)

(72) Inventor: Ken Sakai, Kanagawa (JP)

(73) Assignee: Tyco Electronics Japan G.K., Kawasaki (JP)

( * ) Notice: Subject to any disclaimer, the term of this patent is extended or adjusted under 35 U.S.C. 154(b) by 0 days.

(21) Appl. No.: 16/211,790

(22) Filed: Dec. 6, 2018

(65) Prior Publication Data

US 2019/0173219 A1 Jun. 6, 2019

(30) Foreign Application Priority Data

Dec. 6, 2017 (JP) ..... JP2017-233865

(51) Int. Cl.

| | |
|---|---|
| ***H01R 13/62*** | (2006.01) |
| ***H01R 13/426*** | (2006.01) |
| ***H01R 4/52*** | (2006.01) |
| ***H01R 4/48*** | (2006.01) |
| *H01F 41/10* | (2006.01) |

(52) U.S. Cl.

CPC ..... *H01R 13/426* (2013.01); *H01R 4/4809* (2013.01); *H01R 4/52* (2013.01); *H01F 41/10* (2013.01)

(58) Field of Classification Search

CPC ..... H01R 13/193; H01R 13/20; H01R 13/639
USPC ..... 439/296, 346, 347, 680, 681
See application file for complete search history.

(56) References Cited

U.S. PATENT DOCUMENTS

| | | | | |
|---|---|---|---|---|
| 4,026,013 | A | 5/1977 | Hughes | |
| 7,367,837 | B2 * | 5/2008 | Pabst | H01R 12/592 439/460 |
| 2008/0268693 | A1 * | 10/2008 | Nakamura | H01R 13/4362 439/347 |

FOREIGN PATENT DOCUMENTS

| | | | |
|---|---|---|---|
| EP | 0014789 | A1 | 9/1980 |
| JP | S4979781 | U | 7/1974 |
| JP | 11-307146 | A | 11/1999 |
| WO | 98/38698 | A1 | 9/1998 |

OTHER PUBLICATIONS

Extended European Search Report, European Patent Application No. 18209430.0, dated Apr. 29, 2019, 6 pages.
English machine translation of JPS4979781U, translated Apr. 15, 2019, 3 pages.
Communication from European Patent Office, Application No. 18 209 430.0, dated Nov. 26, 2020, 4 pages.

* cited by examiner

*Primary Examiner* — Phuong Chi Thi Nguyen
(74) *Attorney, Agent, or Firm* — Barley Snyder

(57) ABSTRACT

A connector comprises a terminal member, an elastic member, and a housing having a cavity receiving the terminal member and the elastic member. The terminal member has a contacting face and a back face opposite to the contacting face. The contacting face has a serration region with a serration formed thereon and adapted to contact an electrical wire. The elastic member is adapted to press a pressed region of the back face opposite to the serration region.

19 Claims, 7 Drawing Sheets

CONNECTOR

CROSS-REFERENCE TO RELATED APPLICATION

This application claims the benefit of the filing date under 35 U.S.C. § 119(a)-(d) of Japanese Patent Application No. 2017-233865, filed on Dec. 6, 2017.

FIELD OF THE INVENTION

The present invention relates to a connector and, more particularly, to a connector having a terminal with a serration.

BACKGROUND

A coil made by winding an electrical wire, such as an enameled wire, is present in a motor. A connector is required to connect the electrical wire to an external circuit. A terminal used in such a connector has an uneven portion, also referred to as a serration. A face of the terminal having the serration formed thereon is pressed against the electrical wire to pierce a coating of the electrical wire and form an electrical connection between the terminal and the electrical wire.

Japanese Patent No. H11-307146A discloses a connector including a terminal divided into first and second members each having different roles. The first member is an elastic member in the shape of a cantilever and has a contacting face in the shape of a circular arc with serrations to be pressed against the electrical wire. The second member has a connecting portion for the external circuit and presses the first member against the electrical wire.

The connector in Japanese Patent No. H11-307146A has a structure in which a distal end portion of the cantilever shape of the first member is pressed by the second member. This structure allows the first member to be pressed against an electrical wire having a predetermined thickness with a suitable pressing force. However, the first member can be pressed only against an electrical wire in a narrow range of thicknesses with a suitable pressing force. The connector requires a different design for each electrical wire having a different thickness, and is costly to manufacture due to its narrow range of applicability.

SUMMARY

A connector comprises a terminal member, an elastic member, and a housing having a cavity receiving the terminal member and the elastic member. The terminal member has a contacting face and a back face opposite to the contacting face. The contacting face has a serration region with a serration formed thereon and adapted to contact an electrical wire. The elastic member is adapted to press a pressed region of the back face opposite to the serration region.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
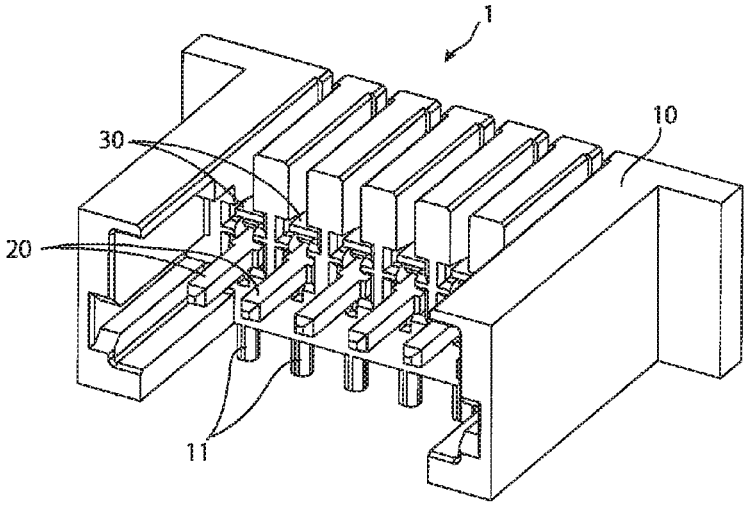
FIG. 1 is a perspective view of a connector according to an embodiment.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

A connector 1 according to an embodiment is shown in FIG. 1. The connector 1 comprises a housing 10, a plurality of terminal members 20, and a plurality of elastic members 30.

The housing 10 is formed of an insulative material and, as shown in FIG. 1, has a plurality of columnar portions 11. In an embodiment, the housing 10 is part of a housing of a motor. A distal end portion 41 of a coil winding 40, shown in FIGS. 5A-5C, inside the motor is wound in several turns around the columnar portion 11. The coil winding 40 establishes electrical continuity with the terminal member 20 as described in greater detail below.

Figure 2:
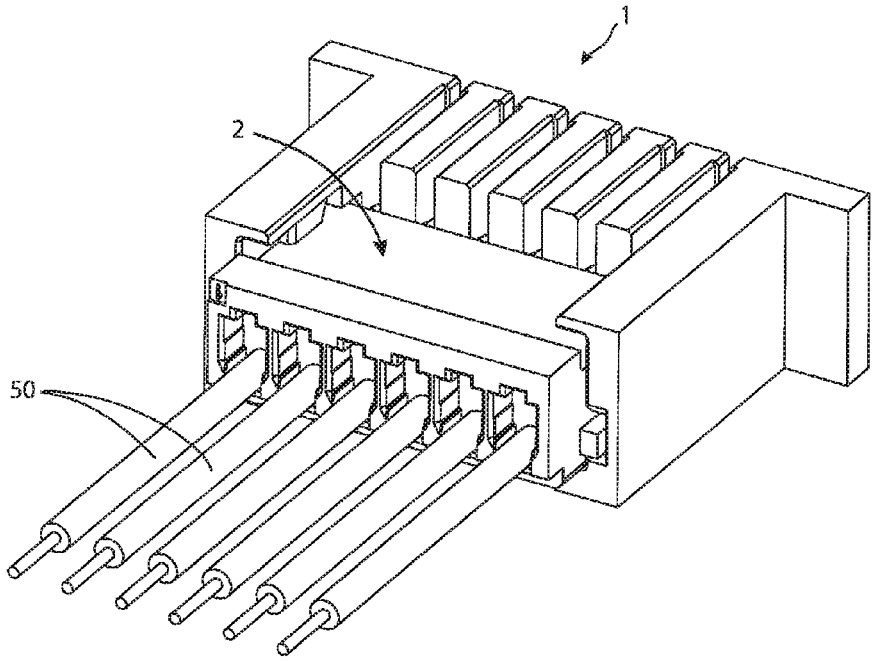
FIG. 2 is a perspective view of the connector mated with a mating connector.

The connector 1, as shown in FIG. 2, is matable with a mating connector 2. End portions of a plurality of electrical wires 50 connected to an external circuit are connected to the mating connector 2. When the mating connector 2 is mated with the connector 1, electric power is supplied from the external circuit to the coil winding 40 of the motor.

Figure 3:
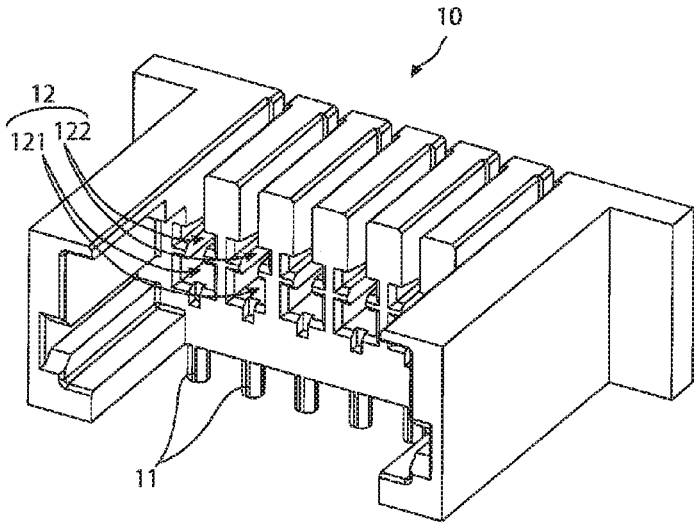
FIG. 3 is a perspective view of a housing of the connector.
Figure 4A:
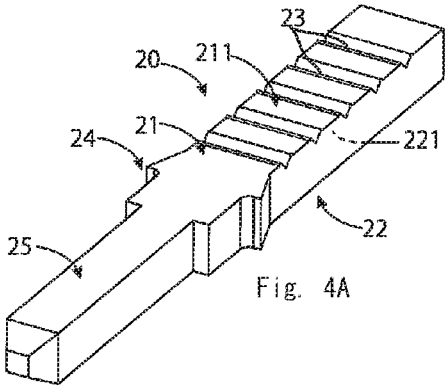
FIG. 4A is a perspective view of a terminal member of the connector.

As shown in FIG. 3, a plurality of cavities 12 are formed in the housing 10. Each cavity 12 is divided into a first chamber 121 and a second chamber 122. The terminal member 20, shown in FIG. 4A, is inserted into the first chamber 121. The elastic member 30, shown in FIG. 4B, is inserted into the second chamber 122.

The terminal member 20 is made of a metal having good conductivity and, as shown in FIG. 4A, has a contacting face 21 and a back face 22 opposite to the contacting face 21. The contacting face 21 has a serration region 211 having a serration 23 formed thereon. The terminal 20 has a press-fit portion 24 for achieving a press fit in the housing 10 and a connecting portion 25 forming an electrical connection with a terminal of the mating connector 2.

Figure 4B:
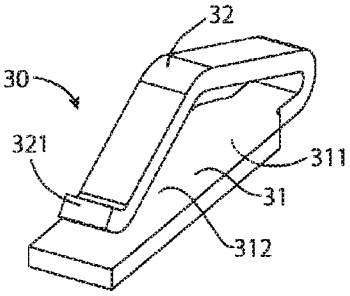
FIG. 4B is a perspective view of an elastic member of the connector.

The elastic member 30 is made of a metal having high elasticity and, as shown in FIG. 4B, has an abutting portion 31 and a pressing portion 32. The abutting portion 31 abuts against an inner wall face, an upper face 124 shown in FIGS. 5A-5C, forming the second chamber 122 of the cavity 12 of the housing 10 and receives a counterforce from the housing 10. The pressing portion 32 is folded back from the abutting portion 31 and presses the back face 22 of the terminal member 20. The pressing portion 32 presses a pressed region 221 opposite to the serration region 211 of the contacting face 21 in the back face 22 of the terminal member 20.

Figure 5A:
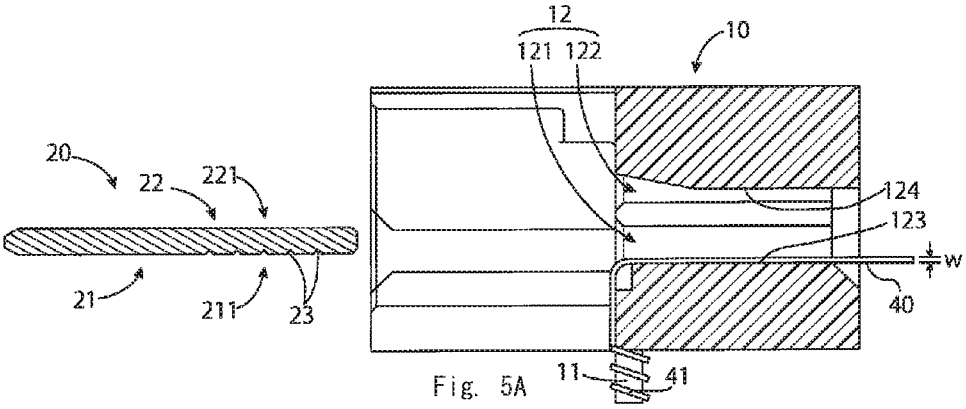
FIG. 5A is a sectional side view of the housing and the terminal member before insertion of the terminal member into the housing.
Figure 5B:
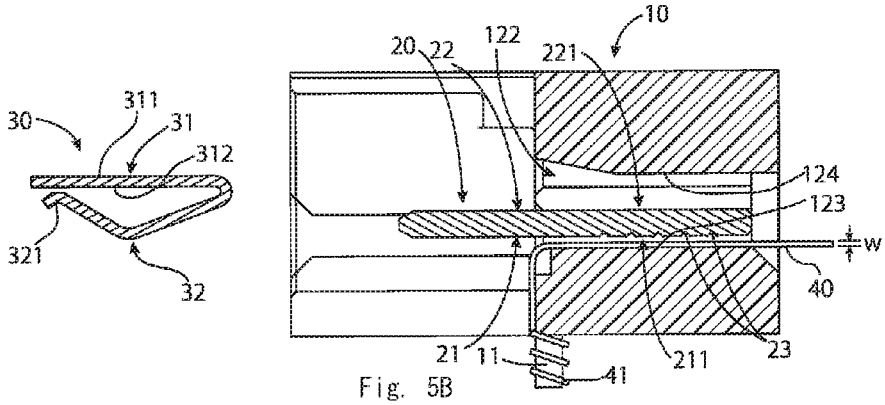
FIG. 5B is a sectional side view of the housing with the terminal member inserted into the housing and before insertion of the elastic member into the housing.
Figure 5C:
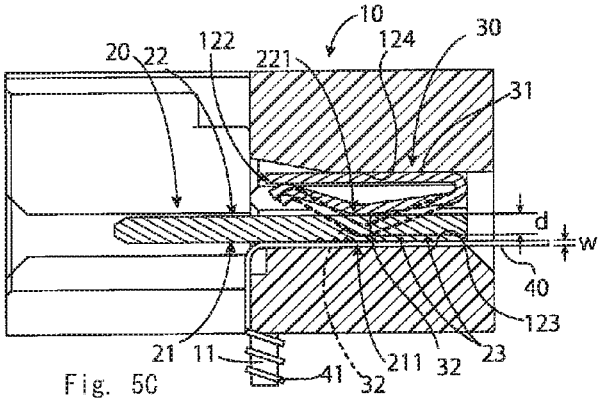
FIG. 5C is a sectional side view of the housing with the terminal member and the elastic member inserted into the housing.

A process of assembly of the connector 1 is shown in FIGS. 5A-5C.

FIG. 5A shows a cross section of the housing 10 before insertion of the terminal member 20. Before the terminal member 20 is inserted, the coil winding 40 is positioned along a lower face 123 defining the cavity 12 of the housing 10. A distal end portion 41 of the coil winding 40 is terminated by winding the distal end portion 41 around the columnar portion 11 of the housing 10. The coil winding 40 is an electrical wire and has a diameter w.

As shown in FIG. 5B, the terminal member 20 is inserted into the first chamber 121 of the cavity 12 of the housing 10 with the contacting face 21 facing toward the coil winding 40. The elastic member 30 is next inserted into the second chamber 122 of the cavity 12 of the housing 10 with the pressing portion 32 facing the terminal member 20.

Thereupon, as shown in FIG. 5C, the pressing portion 32 of the elastic member 30 comes into contact with the pressed region 221 opposite to the serration region 211 in the back face 22 of the terminal member 20, and elastically deforms. In FIG. 5C, the pressing portion 32 after the elastic deformation is shown by a solid line, and the pressing portion 32 before the elastic deformation is shown by a broken line. The pressing portion 32 displaces by a quantity of displacement d due to the elastic deformation of the pressing portion 32 from the state before the elastic deformation.

The elastic deformation of the pressing portion 32, as shown in FIG. 5C, causes the abutting portion 31 of the elastic member 30 to receive the counterforce from the upper face 124 defining the cavity 12 of the housing 10. The pressing portion 32 of the elastic member 30 then presses the terminal member 20 down toward the coil winding 40. The pressing of the terminal member 20 causes the serration 23 formed on the contacting face 21 of the terminal member 20 to pierce a coating of the coil winding 40, which results in an electrical connection between the terminal member 20 and the coil winding 40.

When the elastic member 30 is inserted into the second chamber 122, a distal free end portion 321 of the pressing portion 32 extending from a fixed end of the pressing portion 32 folded back from the abutting portion 31, shown in FIGS. 4B and 5B, abuts against a back face 312 of the pressing portion 31. The back face 312 of the pressing portion 31 is opposite to the abutting face 311. The abutting of the free end portion 321 makes it possible to obtain a greater pressing force, so that the terminal member 20 is more forcefully pressed against the coil winding 40.

The press-fit portion 24 of the terminal member 20, shown in FIG. 4A, is press-fit into the cavity 12 of the housing 10 and prevents the terminal member 20 from slipping out of the cavity 12. The elastic member 30 does not have an equivalent press-fit portion, however, the elastic member 30 elastically deforms inside the cavity 12 and is thereby firmly fitted in the cavity 12. The elastic member 30 is also prevented from slipping out of the cavity 12.

Figure 6:
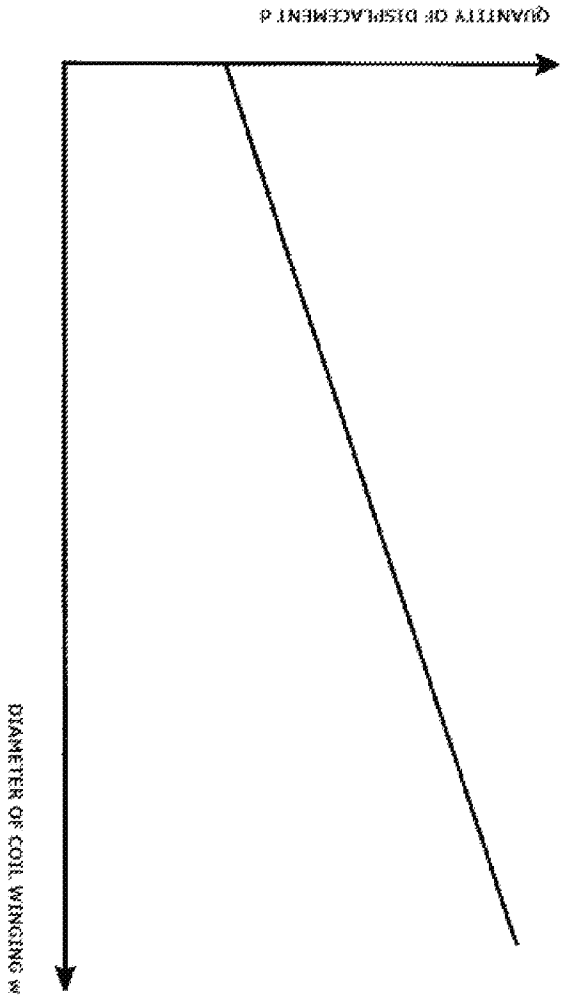
FIG. 6 is a graph of a relationship between a diameter of a coil winding and a quantity of displacement of a pressing portion of the elastic member.

A relationship between the diameter w of the coil winding 40 and the quantity of displacement d of the pressing portion 32 of the elastic member 30 is shown in FIG. 6. Generally, a thick coil winding 40 has a larger current-carrying capacity than a thin coil winding 40, and therefore a wide area of contact is required in an interface between the thick coil winding 40 and the terminal member 20. In order to widen the area of contact, it is effective to flatten a part of the coil winding 40 with an increased pressing force of the terminal member 20. Therefore, in the case of the thick coil winding 40, it is necessary to increase the pressing force of the terminal member 20.

In the connector 1, as shown in FIG. 6, as the diameter w of the coil winding 40 increases, the quantity of displacement d of the pressing portion 32 of the elastic member 30 becomes greater. That is, the terminal member 20 is pressed against a thicker coil winding 40 with a greater pressing force. The elastic member 30 is designed such that a suitable relationship is established between the diameter w of the coil winding 40 and the quantity of displacement d of the pressing portion 32 of the elastic member 30. This makes it possible to press the terminal member 20 against a wide range of diameters of the coil windings 40 with a suitable pressing force using a same connector 1.

Figure 7A:
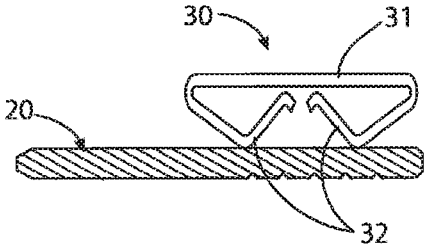
FIG. 7A is a side view of an elastic member according to another embodiment.
Figure 7B:
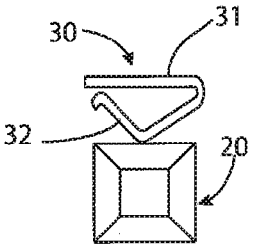
FIG. 7B is an end view of an elastic member according to another embodiment.
Figure 7C:
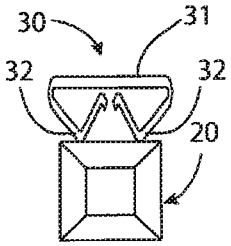
FIG. 7C is an end view of an elastic member according to another embodiment.

Other embodiments of the elastic member 30 are shown in FIGS. 7A-7C. In the elastic member 30 in the embodiment of FIGS. 1-6, the pressing portion 32 has a shape folded back at one end of extension of the abutting portion 31 and then extending like a cantilever.

By contrast, in the elastic member 30 shown in FIG. 7A, a pair of pressing portions 32 are folded back at front and back ends, respectively, of the extension of the abutting portion 31.

In the elastic member 30 shown in FIG. 7B, a pressing portion 32 folded back at one side face of the abutting portion 31 is provided. That is, this elastic member 30 keeps the same shape shown in FIG. 7B but extends in a direction perpendicular to FIG. 7B and perpendicular to the embodiment of FIGS. 1-6.

In the elastic member 30 shown in FIG. 7C, a pair of pressing portions 32 are folded back at both side faces of the abutting portion 31. The elastic member 30 keeps the same shape shown in FIG. 7C but extends in a direction perpendicular to FIG. 7C and perpendicular to the embodiment of FIGS. 1-6.

In other embodiments, in place of the elastic member 30 having the shape shown in FIG. 4B, elastic members 30 having various shapes, each of which has the abutting portion 31 and the pressing portion 32, can be adopted. In other embodiments, terminal members 20 having various shapes can be adopted as the terminal member 20. For example, the connecting portion 25 of the terminal member 20 in the embodiment shown in FIG. 4A has a prismatic shape, but the connecting portion 25 may have a cylindrical shape, or may have a tabular shape, or may have any other shape capable of functioning as the connecting portion 25 described herein.

The connector 1 connected to the coil winding 40 of a motor has been described, however, the present invention is not limited to a connector connected to a coil winding of a motor. The connector 1 is applicable to various fields where an electrical connection is formed by pressing a serration on a terminal against an electrical wire.

What is claimed is:

1. A connector comprising:

a terminal member having a contacting face and a back face opposite to the contacting face, the contacting face having a serration region with a serration formed thereon, the serration region adapted to pierce an insulation film of an electrical wire;

an elastic member adapted to press a pressed region of the back face of the terminal member opposite to the serration region for applying a pressure on the electrical wire and making an electrical connection between the serration region and the electrical wire; and a housing having a cavity receiving the terminal member and the elastic member.

2. The connector of claim 1, wherein the terminal member has a press-fit portion press-fit into the cavity of the housing.

3. The connector of claim 2, wherein the terminal member has a connecting portion forming an electrical connection with a terminal of a mating connector.

4. The connector of claim 1, wherein the electrical wire is a coil winding positioned along a lower face of the housing defining the cavity.

5. The connector of claim 4, wherein a distal end portion of the coil winding is wound around a columnar portion of the housing.

6. The connector of claim 1, wherein the elastic member has an abutting portion with an abutting face adapted to abut against an inner wall face forming the cavity.

7. The connector of claim 6, wherein the abutting portion receives a counterforce from the housing.

8. The connector of claim 7, wherein the elastic member has a pressing portion folded back from the abutting portion and adapted to elastically press the pressed region.

9. The connector of claim 8, wherein a distal free end portion of the pressing portion extends from a fixed end of the pressing portion at which the pressing portion is folded back from the abutting portion.

10. The connector of claim 9, wherein, in a state in which the elastic member is disposed in the cavity and presses the terminal member, the distal free end portion abuts against a back face of the abutting portion, the back face of the abutting portion is opposite to the abutting face.

11. The connector of claim 10, wherein the elastic member has a pair of pressing portions each folded back from the abutting portion and each adapted to elastically press the pressed region.

12. The connector of claim 10, wherein the pressing portion is folded back from an end of the abutting portion in a direction of extension of the abutting portion.

13. The connector of claim 10, wherein the pressing portion is folded back from a side face of the abutting portion.

14. A connector comprising:

a terminal member having a contacting face and a back face opposite to the contacting face, the contacting face having a serration region with a serration formed thereon and adapted to contact an electrical wire;

an elastic member adapted to press a pressed region of the back face of the terminal member opposite to the serration region for applying a pressure on the electrical wire; and a housing having a cavity receiving the terminal member and the elastic member, wherein the elastic member forms an electrical connection between the terminal member and the electrical wire and applies a greater pressing force to the terminal member as the electrical wire increases in diameter.

15. A connector comprising:

a housing defining a cavity;

an electrical wire arranged on a first interior face of the cavity;

a terminal member arranged within the cavity and having a contacting face abutting the electrical wire and a back face opposite the contacting face; and an elastic member arranged within the cavity on a side of the terminal member opposite the electrical wire, the elastic member adapted to press on a region of the back face of the terminal member opposite to the contacting face in a direction of the first interior face of the cavity for applying a pressure on the electrical wire.

16. The connector of claim 15, wherein the elastic member comprises:

an abutting portion abutting on a first side against a second interior face of the cavity, opposite the first interior face; and a pressing portion folded back from the abutting portion and adapted to elastically press on the region of the back face of the terminal member opposite to the contacting face, wherein a distal free end portion of the pressing portion extends from a fixed end of the pressing portion at which the pressing portion is folded back from the abutting portion.

17. The connector of claim 16, wherein, in a state in which the elastic member is disposed in the cavity and presses the terminal member, the distal free end portion abuts against a second side of the abutting portion, opposite the first side.

18. The connector of claim 16, wherein an end portion of the electrical wire is fixedly connected to an exterior of the housing.

19. The connector of claim 16, wherein the contacting face and back face of the terminal member are arranged proximate a first end of the terminal, wherein a second end of the terminal opposite the first end comprises a connecting portion configured to form an electrical connection with a corresponding terminal of a mating connector.

* * * * *